United States Patent [19]

Hotchkiss

[11] Patent Number: 4,834,366

[45] Date of Patent: May 30, 1989

[54] UPPER EXTREMITY FORELEG EMULATING EXERCISER

[76] Inventor: Richard P. Hotchkiss, London Square Apts. #7 Oxford, Clifton Park, N.Y. 12065

[21] Appl. No.: 238,965

[22] Filed: Aug. 24, 1988

Related U.S. Application Data

[63] Continuation-in-part of Ser. No. 109,236, Oct. 16, 1987, abandoned.

[51] Int. Cl.[4] ..... A63B 21/02

[52] U.S. Cl. ..... 272/137; 272/114; 272/141

[58] Field of Search ..... 272/114, 141, 137, 70, 272/70.4

[56] References Cited

U.S. PATENT DOCUMENTS

| | | | |
|---|---|---|---|
| 190,392 | 5/1877 | Weldon | 135/69 |
| 437,024 | 9/1890 | Doe | 135/73 |
| 799,270 | 9/1905 | Roland | 272/141 X |
| 1,088,630 | 2/1914 | Sharp | 135/73 |
| 2,383,786 | 8/1945 | Gish | 135/69 |
| 2,398,247 | 4/1946 | Redcliffe | 135/69 |
| 3,971,255 | 7/1976 | Varney et al. | 272/131 X |
| 4,351,527 | 9/1982 | Crisp, Jr. | 272/141 X |
| 4,580,778 | 4/1986 | Van Noord | 272/135 X |
| 4,688,789 | 8/1987 | Alter | 272/114 X |

FOREIGN PATENT DOCUMENTS

| | | | |
|---|---|---|---|
| 2109484 | 5/1972 | France | 272/141 |
| 308472 | 2/1969 | Sweden | 272/141 |
| 101587 | 10/1916 | United Kingdom | 135/73 |

*Primary Examiner*—Richard J. Apley
*Assistant Examiner*—Franklin L. Gubernick
*Attorney, Agent, or Firm*—Schmeiser, Morelle & Watts

[57] ABSTRACT

An upper-extremity foreleg-emulating exerciser comprising an elongate strut with a handle affixed on its exterior housing and containing a reciprocative compression-expansion mechanism coupled to an armpit-engaging crosspiece. The crosspiece is fitted into the armpit of the user who must then grasp the handle and repeatedly pull the strut toward the armpit and relax it so as to gain the benefit of compressing and releasing the mechanism, to adequately exercise the upper extremity and upper torso of his or her body. Contemporaneous use of a pair of this invention allows the user to perform a plurality of exercises emulating the gait of a four-legged animal and thus, in conjunction with normal walking or rapid pacing, exercise the upper, lower and back portions of his or her body. Alternative in-place exercises may be used to develop pectoral and abdominal muscles as well.

3 Claims, 3 Drawing Sheets

UPPER EXTREMITY FORELEG EMULATING EXERCISER

This application is a Continuation-In-Part of Application Ser. No. 109,236, filed on Oct. 16, 1987, now abandoned.

FIELD OF THE INVENTION

This invention relates generally to exercise devices which employ traditional buffer, dash-pot or shock-absorber compression devices, and more particularly to exercisers which derive their principal benefit from the mimicry or emulation of body parts or extremities as may be found in quadripeds.

BACKGROUND OF THE INVENTION AND PRIOR ART

There are presently many exercisers available on the market for exercising the human torso and upper and lower extremities. Many of the devices which use traditional exercising techniques such as working against compression devices or gravitational apparatus (such as weight lifting) are bulky, heavy and must often be used in an area that is dedicated to such exercising, such as gymnasia and exercise rooms. There appears to be a direct relationship between the degree at which the body may be exercised and the relative size and immobility of the exercise device, that is, devices that exercise a small portion of the body such as the hands can be very small, e.g., a rubber ball; while those that exercise a significant amount of the body, e.g., a rowing machine, are extremely bulky and heavy. As mentioned, the thread of commonality in these types of exercisers is the compression of some medium such as a resilient, compressible material, a spring or elastomeric bars, strands or ropes. Springs are often found in exercisers of the aforementioned types and are most notably seen in the dash-pot, buffer or shock absorber mechanism, such as one would encounter with rowers and similar apparatus. The later apparatus, the shock absorber type, is one of the most useful and is employed in the instant invention because, for its size, it provides the most convenient form of energy storage with linear relaxation characteristics. These characteristics are due, of course, to the spring component of the shock absorber-buffer, as well as the often incorporated use of hydraulics in such mechanisms.

This inventor has devised a unique and truly novel apparatus whereby a single individual might optimize his or her exercise capability using a minimum apparatus which is easily handled, light weight and portable. Indeed, the feature of portability is imperative in the derivation of maximum utility from this invention.

The inventor, long a walker (hiker) who observed that lower extremity and lower torso development was clearly the result of vigorous walking, deduced that upper extremity and upper torso development could also be attained were one to employ the upper extremities as legs, much in the manner as the lower extremities. The major difficulty with emulating the quadraped, and thus deriving equivalent benefit of walking in both the upper torso and extremities, is that the upper extremities of the human being must somehow be lengthened so that a balanced gait might somehow be achieved during the walking exercise. To this end, this inventor has developed both an apparatus and a method for emulating the gait of the quadraped and using a minimum amount of exercising apparatus. The instant invention provides, in effect, extensions for the upper extremities that operate on the familiar shock absorber, dash-pot or buffer principle, are truly portable and, when used properly in the method suggested by this inventor, will afford an exercising regimen that is suitable for alll ages and beneficial to the entire body, prinipally the lower torso and extremities and the upper torso and extremities.

Having conceived the general embodiment of the instant invention, the inventor performed a diligent background search to discover pertinent prior art. Relevant patents discovered were those issued in 1918 to W. F. Bonds, U.S. Pat. No. 1,265,993 for a crutch, and in 1926 to J. B. Glowacki, U.S. Pat. No. 1,580,295 for an adjustable, resilient nonskid crutch.

The Bonds crutch envisioned an essentially rectangular frameword which was fitted in the armpit of the user and which was afforded spring-coupled strut means for contact with the ground, that allowed the user to make adjustments in the length of the strut which terminated with a handle means. The purpose of the spring coupling was to allow the user to pick up the tip of the crutch strut by pulling up very slightly on the handle. This obviated the necessity of raising the shoulder and, of course, had its utility when only one crutch was used. The apparatus of Glowacki inculcated spring type buffer means in the lower portion of the crutch strut. The main thrust of the Glowacki invention was to provide shock absorbing means at the tip of the standard crutch. Since the length of this resilient tip was adjustable, the Glowacki invention allowed the user to employ varying degrees of shock absorbance, depending upon the user's weight as he or she plunged downward on the crutch. Thus, in the relevant prior art, the only use of the shock absorber technology appeared to be for just such a purpose; and, the use of compression means (a spring) was used for the purpose of lifting the crutch tip a couple of inches so that the shoulder would not have to be raised. This latter technique was further employable so as to keep the shoulders barely level and not, by any means, to effect the rolling gait of a quadraped.

The disadvantages of most full-body exercisers have been overcome by the instant invention and the paucity of prior art relating to the instant invention clearly indicates that its availability will provide the average exerciser an inexpensive, truly functional apparatus of great utility.

SUMMARY OF THE INVENTION

The advantages of a light-weight, portable, exercise device for exercising the upper extremities and torso, while affording the user the benefits of walking exercise, are acquired through the use of the instant invention. A modified crutch is used to emulate the gait of a quadraped by providing an apparatus that can be forcefully reciprocated, by the arm of the user, in much the manner of a foreleg being extended and then retracted.

The preferred embodiment conceives of a strut portion of a stylized crutch such as is normally used to aid the ambulatory handicapped. The strut, or lower section contains a longitudinal chamber which holds a resilient, through readily compressible expansion means—either a mechanism or composition. Fitted into the upper portion of the chamber, so as to be in registry with the expansion means, is a piston/extension shaft device which, in cooperation with the expander/chamber, comprises a dash-pot, buffer or, in more current terms, a shock-absorber in which the range of piston shaft motion is at least 12 inches. At the top of the piston's extension shaft, which may comprise a singular element (the piston being here contiguous with the shaft and termed the upper section of the invention) there is fixed a crosspiece. The function of the crosspiece is like that of a traditional crutch crosspiece—to fit under the arm being exercised, into the armpit. Approximately 16–19 inches down from the crosspiece and situated perpendicularly on the strut's outer housing is a handle that is grasped by the hand respective of the arm being exercised which allows the user to force the shaft into the chamber as much as 18 inches.

The method of operation (exercise) is for the user to place one of the aforementioned devices under each arm. Notably, the use of two such devices is not mandatory, but full use of the optimal exercise program is attained by paired usage. The user may emulate one of two common gaits of the quadraped—the "cross gait" where the left fore and the right rear legs are off the ground simultaneously, alternating to right fore, left rear off; and the "parallel gait," where the fore and rear legs on one side are off the ground and alternatingly both legs of the other side are lifted off. The user leans forward slightly, placing his/her weight down on the devices, in the manner of crutch usage. This is important. Selectively, the handle is grasped and the lower strut brought toward the armpit working against the expander means. Such action approximately 9 to 14 inches, exercises the "front legs", the upper arms and torso, while emulating the rolling gait of, say a bear, and deriving the benefits of a slightly stooped rapid walk for the lower extremities and torso.

BRIEF DESCRIPTION OF THE DRAWINGS Of the drawings.

DESCRIPTION OF THE PREFERRED EMBODIMENT

Figure 1:
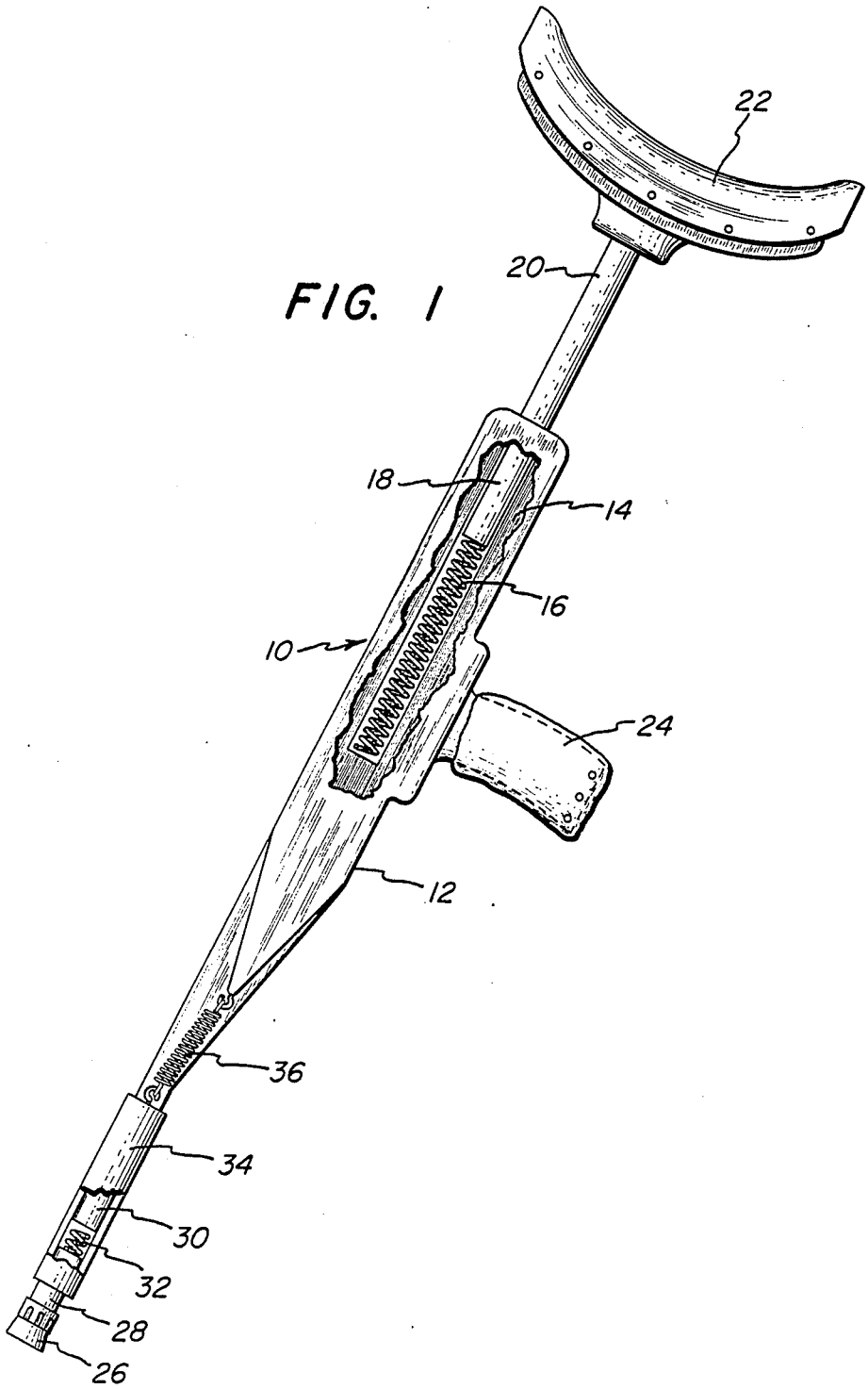
FIG. 1 is a partial cut-away side elevation of the invention.
Figure 2A:
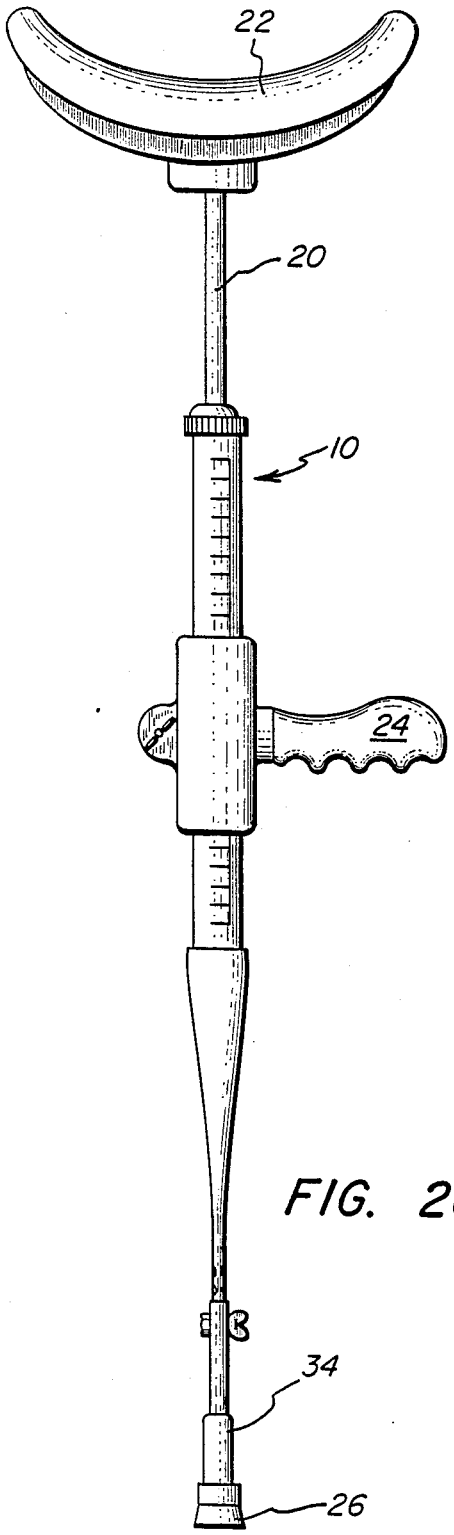
FIG. 2 illustrates front and side elevations of but one physical embodiment of the invention.
Figure 2B:
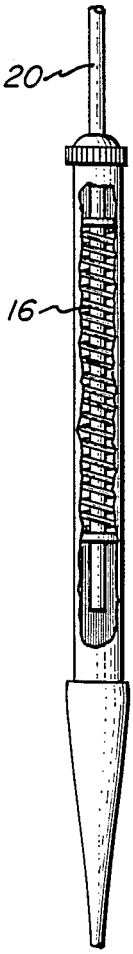

Referring particularly now to FIG. 1, there is illustrated a partially cut-away view of the invention 10. The elongate strut portion 12 is seen adapted with an optional shock absorbing tip mechanism 26–36. The longitudinal chamber 14 in the strut 12 serves to contain a compressible, resilient mechanism, in this instance, spring 16. Chamber 14 is only long enough to contain the expanded resilient media or spring 16 and the piston 18 portion of piston/extender shaft 20. As was mentioned earlier, piston 18 may be distinct from extender shaft 20 or may be contiguous (as shown here) therewith. Extender shaft 20 terminates at its uppermost portion in crosspiece 22, which is normally fitted into the armpit of the user. Handle means 24 are provided at the exterior surface of strut 12 approximately 16–19 inches down-strut from crosspiece 22. This allows the avenger person to make comfortable usage of the device. In some instances, it may be necessary to shorten extension shaft 20, but this technique is well known to those of ordinary skill in the art. Also disclosed in the prior art, are means for affording some reduction of the contact shock if the strut is laid down too rapidly by the user. These means comprise the shock absorbing mechanism 26–34 that is depicted also in FIG. 1 and FIG. 2 (not shown in detail). Ideally, this shock absorbing mechanism is not required as the experienced user of the invention will soon discover that a traumatic contact with the ground at tip 26 is not envisioned by the inventor nor is it likely to be too common an occurrence. Nonetheless, the tip shock absorbing means are provided and comprise a crutch type end tip 26, tip extension shaft 28 in registry with coil spring 32 and strut end 30, the latter three members being fully enclosed by shock absorbing cylinder or housing 34 in FIG. 1, and held to the lower end of strut 12 by exterior springs 36. Once again, as will be envisioned by those having ordinary skill in this art, there are other efficacious means of providing shock absorbance for the tip of the strut such as seen in FIG. 2.

Figure 3:
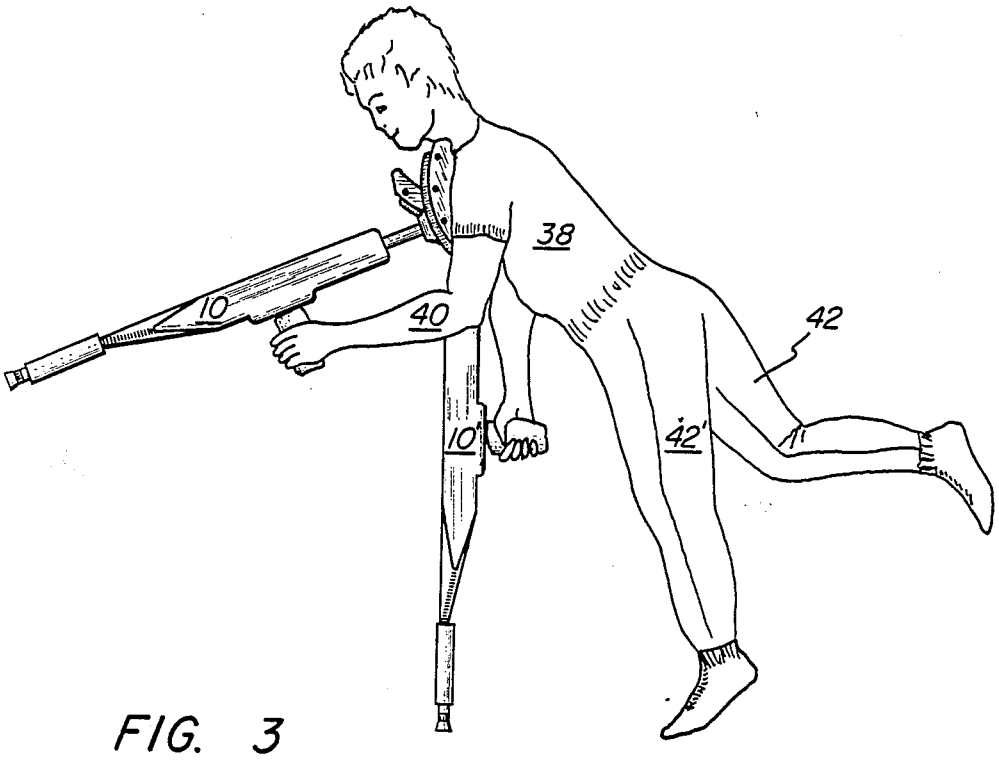
FIG. 3 is a side view of an individual employing a pair of the invention while executing the cross gait exercise (exaggerated).

As will be discussed in the next section, an application of the invention is envisioned by the illustration of FIG. 3. Here the user 38 is in an exaggerated forward slant posture so that the reader may readily discern that he is employing a pair of the invention 10, 10' in the cross-gait exercise mode. Note that the left arm 40 has compressed device 10 and the upper left side of the torso is in tension, while the right leg and foot 42 are clearly off the ground. Because of the exaggerated pitched forward posture, it appears that the individual 38 is actually supporting his weight on right "fore leg" strut 10'. As mentioned briefly, before, this may not be so; the entire weight of the body may in actuality rest on left leg 42'. Most of the actual action of the exercise is performed using the upper extremities and torso while manipulating the paired invention. It therefore follows that the next step or frame in this sequence would be the placement of the right leg and foot 42 on to the ground and the near simultaneous compression of device 10' while the left device 10 is allowed to relax by the relaxation of arm 40, while bringing the strut into a near vertical position.

Method of Employing the Preferred Embodiment

The following is an explanation of the methods of exercising that will employ the instant invention and may be followed by users of this novel and useful exercise equipment. For the purposes of making a comprehensive disclosure in this section certain definitions and terminologies will be used:

Forelegs

A pair of the invention that will function like animal forelegs.

Backlegs

The user's own natural legs and feet.

Point

The touching down on the surface or ground of any single foreleg or backleg upon the completion of a step forward by that member or the touching down of a foreleg simultaneously with a back leg in completing a collective step, e.g., the touching down of the right backleg and the left foreleg simultaneously, so as to make one sound, constitutes one point.

Parallel Gait

A gait in which the right backleg and the right foreleg execute a joint and simultaneous forward step (one point) and the left backleg and the left foreleg execute a joint and simultaneous forward step (one point), and the locomotion is continued in such fashion.

Diagonal or Cross Gait.

A gait in which the right backleg and the left foreleg execute a joint and simultaneous forward step (one point) and the left backleg and the right foreleg execute a joint and simultaneous forward step (one point), and the locomotion is continued in such fashion.

Separate—Step Gait

A gait in which the limbs make separate and complete steps individually in a regular, repeated pattern.

Essentially, the method of exercising the upper extremities and upper torso, employing the instant invention, comprises two basic steps: posturing at least one upper extremity foreleg in the armpit, and grasping the exerciser's handle with the respective hand (and) repeatedly exercising the respective arm and upper torso by compressing the exerciser and alternatively allowing relaxation of the apparatus. Several four legged gaits may be emulated by combining the normal walking exercise of the user with the aforementioned method of exercise (with the instant invention) so as to maximize the benefit of the apparatus-supplemented regimen.

The inventor believes that the most beneficial and most easily executed exercise comprises what is known as the "diagonal two point walk". In this method, the right backleg and the left foreleg are lifted at the same time, the left foreleg obviously by compressing the invention, while completing a simultaneous one-point forward; then the left backleg and the right foreleg are lifted at the same time and the user completes another simultaneously one-point forward step; and, the user continues walking in that pattern. As the forelegs are individually retracted upward by the hand, and the interior spring of the preferred embodiment is compressed, the exerciser can take note that the muscles of the upper side of the forearm and the biceps of the shoulder (deltoid) muscles are all flexed. The higher one lifts the foreleg handle, the more vigorous that part of the exercise. When the lower tip of the foreleg has been placed on the floor or ground to continue with the walk, it is inportant that the novice user relax somewhat, forearm stiff, and allow the foreleg handle to bear the weight of his forward leaning upper body, in order to acquire initial skill with the invention. Thid action will not be without benefit, as when such is performed, the muscles of the underside of the forearm and the triceps, shoulder and chest (pectoral) muscles are all flexed. The inventor is of the belief that during this exercise the letissimus and other muscles of the back are involved to a certain degree. If one pulls back on the handles as one walks along, the letissimus muscles will definitely be contracted and exercised.

The "parallel, two point walk" is achieved by lifting the foreleg and the left backleg at the same time in completing a simultaneous one-point step forward, followed by lifting the right foreleg and the right backleg in completing another simultaneous one-point step forward. Continuation of the exercise is made by walking forward in such a pattern. Many variations of these two walks can now be entertained as well as a more rapid walk or trot. In fact, it is possible to emulate the trot, pace, canter and gallop of a for legged animal by simply observing how that animal executes its gait and emulating it with the instant invention.

Lest the user acquire an erroneous belief, the instant invention is useful in nonwalking types of exercise. This is best exemplified in what the inventor terms the "push-up, knees-up" exercise. This exercise is not a gait. To accomplish it properly, the user places the forelegs in a normal parallel starting position with the tips on the floor somewhat forward. Then he or she squats downward until the elbows are fully flexed and the interior springs are totally compressed. The exerciser then gives a push with one or both back feet to propel him-or herself in an arc forward. Immediately after the push with the foot, the exerciser raises himself or herself upward by straightening the arms while at the same time, raising the knees until the thighs are more or less parallel to the floor. Being thus suspended, the user continues moving until the arc is completed and the legs are thrust forward (slanted) to the floor to stop the movement. The primary purpose of this exercise is to strengthen the stomach muscles, which are largely unaffected by the gait exercises. This also serves as a powerful supplementry exercise for the arms, shoulders and chest muscles.

The embodiments, methods and procedures disclosed herein have been discussed for the purpose of familiarizing the reader with the novel aspects of this invention. Disclosure of the invention bearing such common trappings as compression springs and crutch-like profile are not meant to be restrictions but rather have been provided so as to clearly point out and exemplify the invention. Those having ordinary skill in this area of endeavor, through constant practice with the invention, will be able to develop modifications therefor and expansive regimens of physical exercise to be conducted therewith. Such activity and development is to be limited only by the appended claims.

What is claimed:

1. An upper extremity foreleg emulating exerciser comprising an elongate dash-pot type shock absorber having a suitable casing from which protrudes a moveable, extensible piston shaft, said shock absorber containing a resilient expansion means for urging said shaft out of said absorber, said resilient expansion means extensible at least to a point proximate the vertical midpoint of said casing to allow a range of piston shaft motion of at least 12 inches; a handle projecting orthogonally from said casing said shock absorber further comprising an elongated strut having a crutch-type outer tip attached to said casing and extending opposite and coextensive said piston shaft; and, a cross piece on the upper end of said moveable piston shaft.

2. The invention of claim 1 wherein said elongate strut further comprises a shock absorbing means for at least partially absorbing shock forces created when said tip contacts a surface.

3. An upper extremity foreleg emulating exerciser comprising:

a shock absorber, said absorber comprising an elongated case from which extends a fixed lower strut and a moveable extensible upper piston shaft having an outer end, said piston shaft adapted for resilient biasing by a resilient means which resides inside said absorber, said piston shaft also adapted for cross piece attachment at its outer exensible end, said resilient expansion means extensible at least to a point proximate the vertical midpoint of said absorber allowing a range of piston shaft motion of at least 12 inches;

an arcuate cross piece attached only by a single point on said cross piece to the outer end of said piston shaft, said cross piece of sufficient arcuate length for comfortable placement in the user's armpit so as to allow rotation to the fore and rear of the user as the user purposefully and repeatedly compresses and releases said absorber;

A single-piece handle projecting orthogonally from said absorber case and fixed proximate the middle of said case, said handle to be grasped by the exerciser user to compress and release said absorber, whereby when a user places said cross piece in the armpit and said handle is grasped and oriented to the user's rear, said shock absorber may be urged towards the armpit allowing said arcuate cross piece to rotate slightly to the rear allowing the user to emulate a forelegged gait.

* * * * *